US006595663B2

(12) United States Patent
Tsao

(10) Patent No.: US 6,595,663 B2
(45) Date of Patent: Jul. 22, 2003

(54) WORK LIGHT CAGE ATTACHMENT SYSTEM

(76) Inventor: Frank Tsao, 5 Pl. no. 79, Kang fu Road, Sec. 1, Sanchung City, Taipei Hsian (TW)

( * ) Notice: Subject to any disclaimer, the term of this patent is extended or adjusted under 35 U.S.C. 154(b) by 0 days.

(21) Appl. No.: 10/068,690

(22) Filed: Feb. 6, 2002

(65) Prior Publication Data

US 2002/0109995 A1 Aug. 15, 2002

Related U.S. Application Data

(60) Provisional application No. 60/267,379, filed on Feb. 7, 2001.

(51) Int. Cl.[7] ..... F21V 17/00; F21V 15/02

(52) U.S. Cl. ..... 362/374; 362/376

(58) Field of Search ..... 362/185, 290–292, 362/342, 354, 374–378

(56) References Cited

U.S. PATENT DOCUMENTS 1,923,970 A * 8/1933 Dowling ..... 362/376
2,065,814 A * 12/1936 Lennon ..... 362/290
4,175,282 A * 11/1979 Grindle et al. ..... 362/374
4,573,111 A * 2/1986 Herst et al. ..... 362/291
5,195,823 A * 3/1993 Sidabras ..... 362/376
5,196,674 A * 3/1993 Chartrain et al. ..... 362/376
5,243,507 A * 9/1993 Atkins et al. ..... 362/376
5,493,484 A * 2/1996 Osteen et al. ..... 362/375
D385,640 S 10/1997 Leen ..... D26/63
5,984,490 A 11/1999 Leen ..... 362/240
D449,398 S 10/2001 Tsao ..... D26/63

* cited by examiner

*Primary Examiner*—Alan Cariaso
(74) *Attorney, Agent, or Firm*—Dean A. Craine

(57) ABSTRACT

A work light cage attachment system which includes a cage that securely attaches over the glass opening on a work light. The cage includes opposite top and bottom frame members and opposite side frame members. Attached to the comers of the top and bottom frame members are rearward extending legs. Each extending leg includes a perpendicularly aligned foot that, during assembly, is placed inside the gap between the edge of the faceplate and the glass and extends outward to prevent disengagement of the cage from the faceplate. Attached to each foot on the top and bottom frame members is a C-shaped clip which engages a raised lip formed on the inside surface of the faceplate. The lips prevent the cage from being removed from the work light without a tool, thus meeting United Laboratories code.

4 Claims, 4 Drawing Sheets

WORK LIGHT CAGE ATTACHMENT SYSTEM

This is a utility patent application based on a provisional patent application (Ser. No. 60/267,379) filed on Feb. 7, 2001.

BACKGROUND OF THE INVENTION

1. Field of the Invention

This invention pertains to work lights, and more particularly, to work lights with a protective outer cage attached to the front of the light.

2. Description of the Related Art

Portable work lights are manufactured and sold by many companies. Because a large number of companies manufacture these work lights, they must be sold at competitive prices in large quantities with very small profit margins.

Most portable work lights 12 in the prior art (FIG. 1) include an outer housing 13 which contains the bulb 14 with a square or rectangular-shaped piece of glass 15 covering a front opening 16. The piece of glass 15 protects the bulb 14 by preventing objects, water, and dirt from entering the outer housing 13. The piece of glass 15 is held in place on the housing 13 by a removable faceplate 17. Screws or other suitable connectors (not shown) are used to attach the faceplate 17 to the outer housing 13. Clips (not shown) are used to attach the piece of glass 15 to the inside surface of the faceplate 17 so that the piece of glass 15 and faceplate 17 may be removed as a single unit from the outer housing 13 when replacing a bulb 14.

Many work lights 12, also include a forward extending cage 20 that protects the piece of glass 15 and prevents objects or surfaces from being placed too close to the piece of glass 15 and igniting. Typically, the cage 20 is attached to the front surface of the faceplate 17 with external clips 18 attached with threaded connectors 19, as shown in FIG. 1.

Many portable work lights sold in the United States are manufactured in foreign countries and then shipped to the United States in their retail boxes. One drawback of doing so is the additional cost of shipping the work lights to the United States for sale. One factor that influences the cost of shipping is the size and shape of the retail container. Typically, it is desirable to ship the work lights in a partially assembled configuration so that the size of the retail container may be reduced. Such work lights require assembly by the purchaser prior to use.

Underwriters Laboratories, Inc. (UL) is an independent, not-for-profit, product safety testing and certification organization. Many retailers require that portable work lights be tested and certified by this organization before they are sold in their stores. In order for portable work lights to be certified, the cages on the work lights must be securely attached to the faceplate so that they cannot be accidentally removed from the work light. One adopted standard is that a hand tool, such as a screwdriver, be required to remove the cage from the faceplate. While clips attached with threaded connectors meet this requirement, they also require the use of hand tools to attach the clips to the faceplate. Typically, the clips and cages are attached to the faceplate by the manufacturer and shipped in a box to the retailer. Because the cages extend forward on the faceplate, the size of the box must be larger than a box used to hold work lights with the cages detached. What is needed is a work light cage attachment system that enables the manufacturer to ship the work lights with the cages detached so that smaller boxes may be used and enables the end user to easily attach the cage of the faceplate of a work light without using external clips and requires the use of a hand tool for the removal of the cage from the faceplate without a hand tool.

SUMMARY OF THE INVENTION

It is a general object of the present invention to provide a work light that is less expensive to ship and still meets Underwriters Laboratories approval.

It is an object of the present invention to provide a work light cage attachment system that enables the cage to be detached from the work light housing when shipped and then easily attached by the end user.

It is another object of the present invention to provide such a system that requires the use of a hand tool to remove the cage from the faceplate. These and other objects of the invention which will become apparent are met by an improved work light cage attachment system that enables the work light to be shipped with the cage detached so that the overall size of the shipping box may be reduced. During assembly, the cage is easily attached to the work light without a hand tool yet requires the use of a hand tool for its removal. The system includes a cage that securely attaches to the faceplate over the glass opening on the work light. The cage includes a plurality of horizontal and vertical frame members. Attached to each comer and perpendicularly aligned to the cage planar surface is a rearward extending leg. Each leg includes a perpendicularly aligned foot that, during assembly, extends outwardly into a gap opening located between the inside surface of the faceplate and the glass. Attached to each foot is a clip with a central extending stop member. Formed on the inside surface of the faceplate adjacent to the upper and lower edges of the glass opening are two raised lips. During operation, the legs may be easily forced together and inserted into the four comers of the glass opening so that the clips are inserted into the gap openings located between the faceplate and the glass. The lips prevent the removal of the stop members without a hand tool, thus meeting Underwriters Laboratories code.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

DESCRIPTION OF THE PREFERRED EMBODIMENT(S)

Figure 1:
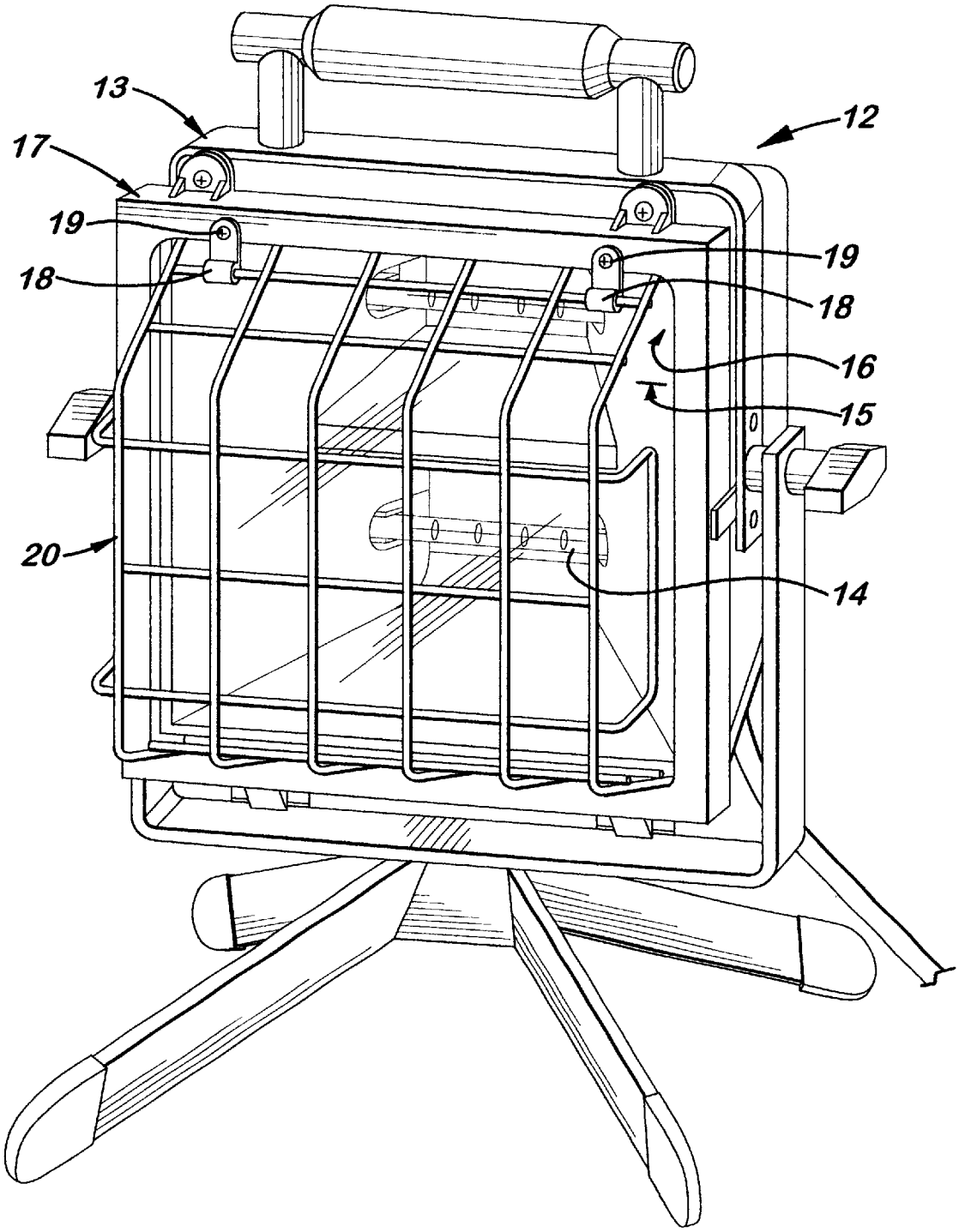
FIG. 1 (PRIOR ART)
FIG. 1 is a perspective view of the work light found in the prior art that uses clips to attach the cage to the faceplate.
Figure 2:
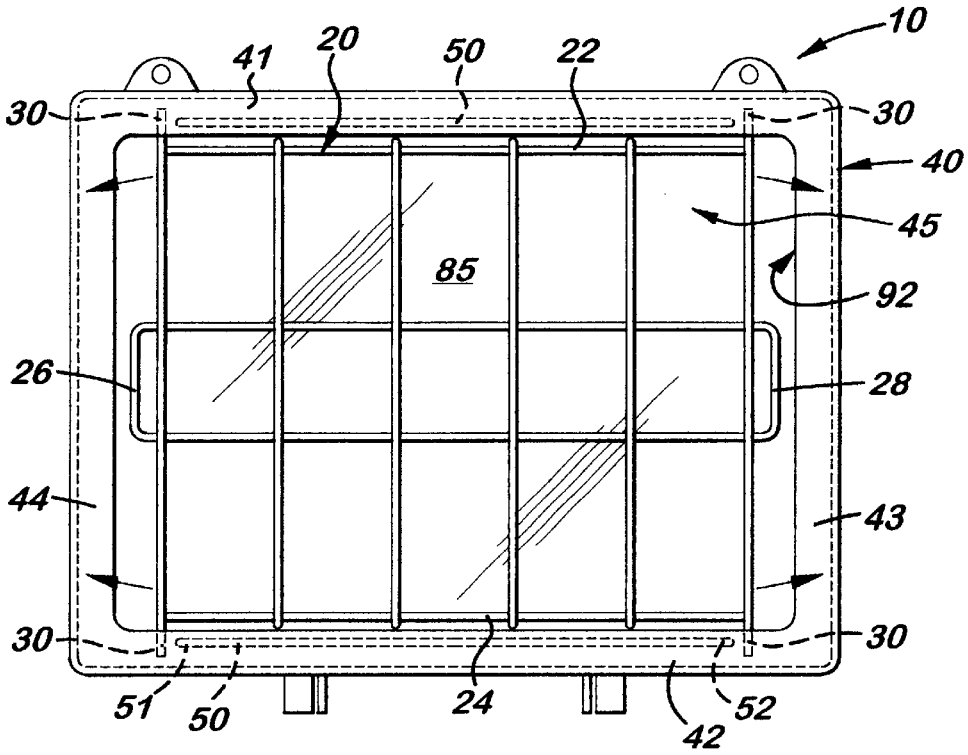
FIG. 2 is a front elevational view of a work light with the cage attached thereto using the attachment system disclosed herein.
Figure 3:
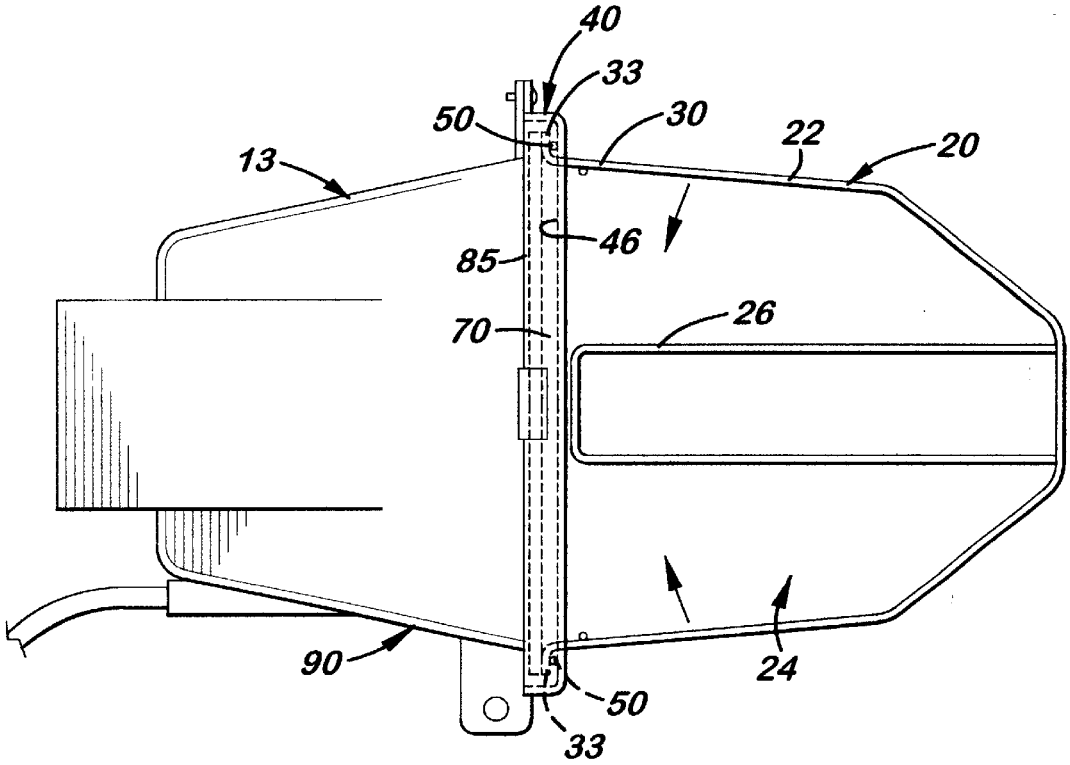
FIG. 3 is a side elevational view of the work light shown in FIG. 2.

Referring to the accompanying FIGS. 2–6, there is shown and described a work light cage attachment system generally referenced as 10 which includes a cage 20 that securely attaches to an improved faceplate 40 that covers the front opening 92 on a work light 90. The cage 20 includes opposite top and bottom frame members 22, 24, respectively, and opposite side frame members 26, 28. Attached to the corners of the top and bottom frame members 22, 24 and longitudinally aligned with the side frame members 26, 28 are rearward extending legs 30.

The improved faceplate 40 is a square or rectangular structure with parallel top and bottom members 41, 42 and parallel side members 43, 44 located centrally in a glass opening 45. Attached or formed on the inside surface 46 of the faceplate 40 immediately adjacent to the top and bottom members 41, 42 of the glass opening 45 are horizontally aligned elongated lips 50. Each lip 50 is shorter than the width of the glass opening 45 thereby creating an opening 48 between the opposite ends 51, 52 of each lip 50 and the side members 43, 44.

Figure 4:
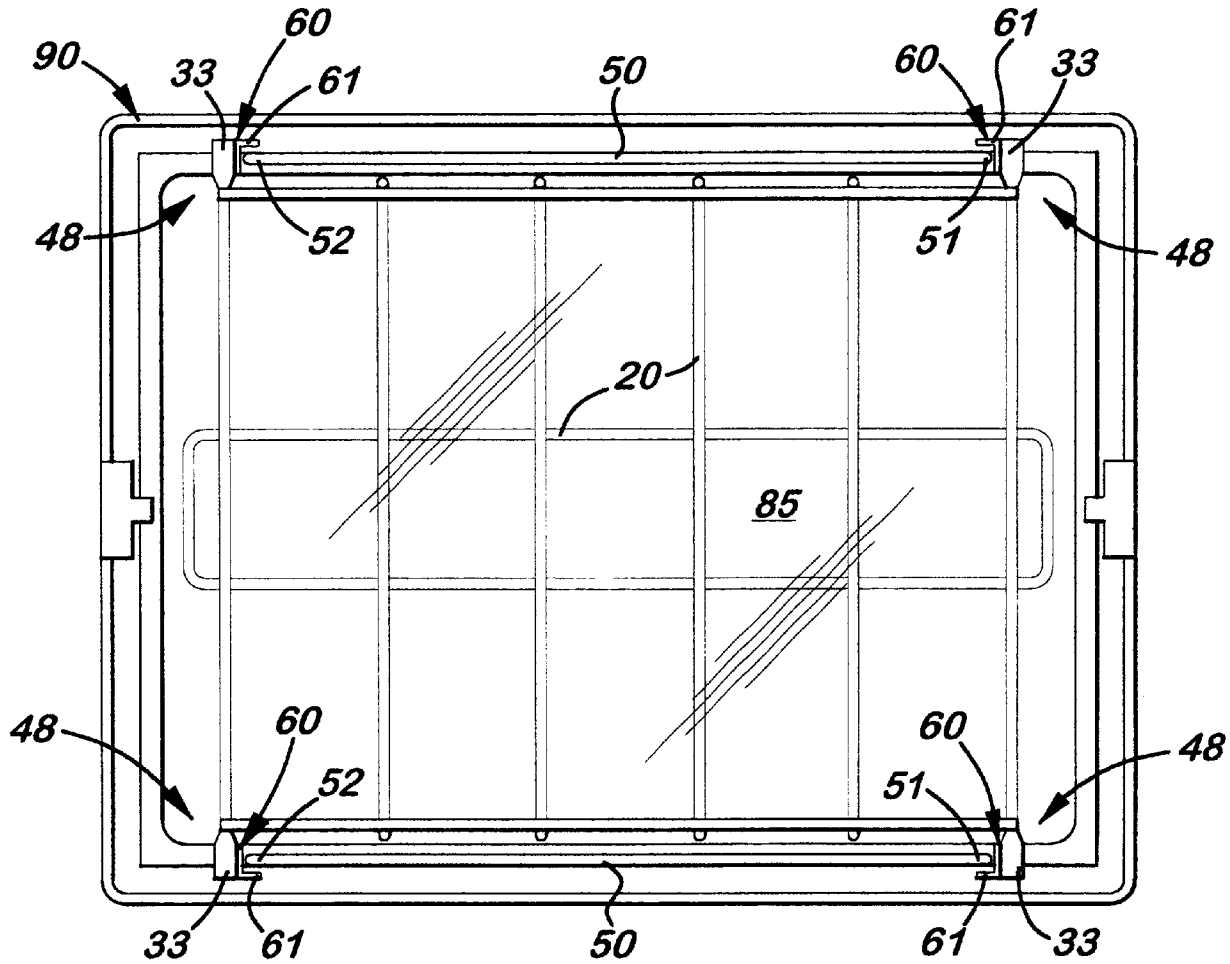
FIG. 4 is a rear elevational view of the faceplate showing the legs of the cage attached to the inside surface of the faceplate.
Figure 5:
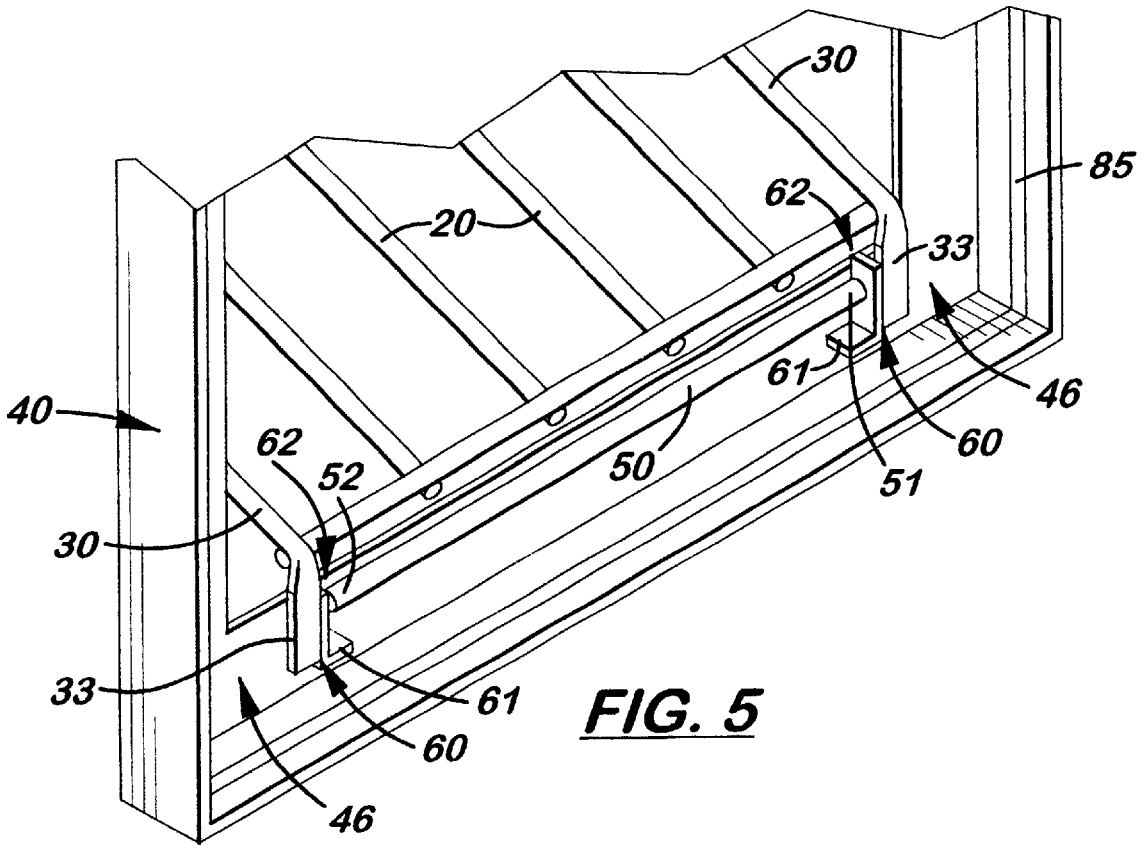
FIG. 5 is a partial view of the faceplate shown in FIG. 4.
Figure 6:
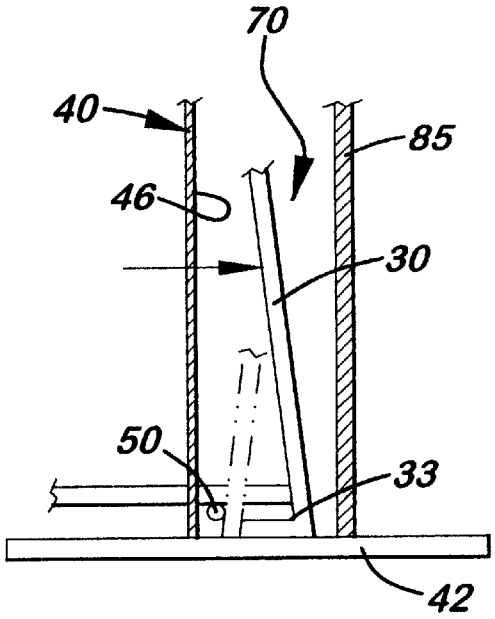
FIG. 6 is a partial side elevational view of a leg (with the clip removed) of the cage being pressed inward so that the feet can be inserted through the opening on the faceplate.

Each extending leg 30 includes a perpendicularly aligned, vertically extending foot 33 that, during assembly, is placed inside the gap opening 70 located between the inside surface 46 of the faceplate 40 and the front surface of the glass 85, as shown in FIG. 5 and 6. As shown in FIG. 4, attached to the inside surface of each foot 33 is an L-shaped clip 60 with a central extending stop member 61. During operation, the stop member 61 extends inward and is blocked by the end of a lip 50, preventing the legs 30 from being removed from the outer housing 13 without a hand tool, and thus meeting Underwriters Laboratories code.

In the preferred embodiment, a gap 62 is created between the stop member 61 and the end of the lip 50 which is approximately 1/16 inch in width.

To attach the cage 20 to the outer housing 13, the cage 20 is aligned and registered over the glass opening 45 of the faceplate 40. The top and bottom frame members 22, 24 are then manually squeezed together so that each leg 30 and foot 33 is forced into the comers of the glass opening 45. During the insertion process, the stop members 61 are able to slightly distort to easily slide over the ends of the lips 50.

To remove the cage 20 from the outer housing 13, the tip of a screwdriver or similar tool must be placed into the gap 62 and rotated outward, thereby forcing the stop member 61 away from the end of the lip 50. The top and bottom frame members 22, 24 can then be squeezed together to pull the stop member 61 through the front opening 92. The process is repeated until all of the stop members 61 have been pulled free.

In compliance with the statute, the invention described herein has been described in language more or less specific as to structural features. It should be understood, however, that the invention is not limited to the specific features shown, since the means and construction shown, is comprised only of the preferred embodiments for putting the invention into effect. The invention is therefore claimed in any of its forms or modifications within the legitimate and valid scope of the amended claims, appropriately interpreted in accordance with the doctrine of equivalents.

I claim:

1. A work light cage attachment system, comprising:

a. a removable faceplate used on a work light, said faceplate having a glass opening and an inside surface;

b. an upper and lower raised lip attached to said inside surface of said faceplate adjacent to said glass opening and said lips creating at least two slot openings on opposite sides of said lips;

c. a forward extending cage selectively attached over said glass opening, said cage including at least two upper and two lower legs, each said leg having a perpendicularly aligned foot, and that is disposed against said inside surface of said faceplate when said cage is attached over said glass opening; and, d. a centrally extending stop member attached to said leg adjacent to said foot, said stop member used to prevent disengagement of said foot from said front opening.

2. The work light cage attachment system, as recited in claim 1, wherein said lip extends transversely on said inside surface of said faceplate.

3. The work light attachment, as recited in claim 2, wherein said stop member is a clip attached to each said leg.

4. A work light cage attachment system, comprising:

a. a removable raised faceplate attachable to the front opening of a work light, said faceplate including a glass opening with top and bottom edges;

b. a raised lip formed on said inside surface of said faceplate;

c. a cage selectively attached to said faceplate, said cage including two pairs of flexible legs that insert into said glass opening, each said leg including a foot that extends into a gap located between said faceplate and said front opening of a work light; and, d. a clip attached to each said leg, said clip including a stop member and engaging said lip to prevent the removal of said leg from said faceplate.

* * * * *